US007000790B1

(12) United States Patent
Bae

(10) Patent No.: US 7,000,790 B1
(45) Date of Patent: Feb. 21, 2006

(54) BOTTLE CAP

(75) Inventor: Shin-Young Bae, Kunpo-Si (KR)

(73) Assignee: Iplastic Co., Ltd., Kyougki-do (KR)

( * ) Notice: Subject to any disclaimer, the term of this patent is extended or adjusted under 35 U.S.C. 154(b) by 0 days.

(21) Appl. No.: 10/069,871

(22) PCT Filed: Sep. 6, 2000

(86) PCT No.: PCT/KR00/01014

§ 371 (c)(1),
(2), (4) Date: May 22, 2002

(87) PCT Pub. No.: WO01/17871

PCT Pub. Date: Mar. 15, 2001

(30) Foreign Application Priority Data

Sep. 6, 1999 (KR) ..... 1999/18866

(51) Int. Cl.
*B65D 41/04* (2006.01)

(52) U.S. Cl. ..... 215/230; 215/204; 215/334; 206/459.1

(58) Field of Classification Search ..... 215/334, 215/330, 217, 230, 218–220; 206/459.1
See application file for complete search history.

(56) References Cited

U.S. PATENT DOCUMENTS 2,939,597 A * 6/1960 Greene ..... 215/230
3,027,035 A * 3/1962 Farago ..... 215/219
3,871,545 A 3/1975 Bereziat
3,892,325 A * 7/1975 Maguire ..... 215/219
3,946,890 A * 3/1976 Scuderi ..... 215/220
4,138,029 A * 2/1979 Mahoney ..... 215/230
4,394,916 A * 7/1983 Smalley ..... 215/220
4,446,979 A * 5/1984 Gach et al. ..... 215/203
4,500,005 A * 2/1985 Forrester ..... 215/203

(Continued)

*Primary Examiner*—Robin A. Hylton
(74) *Attorney, Agent, or Firm*—John M. Naber; Dickinson Wright PLLC

(57) ABSTRACT

There is provided a bottle cap configured such that consumers can easily identify the opening or closing of a cap openably installed on the mouth of a liquor bottle. The bottle cap for a bottle which holds contents, includes a cap body having an inner cap coupled so as to open or close the mouth of the bottle, and an outer cap made to rotate in a circumferential direction only and fixedly coupled to the inner cap so as not to deviate from the inner cap, ratcheting means having first and second teeth formed at facing portions of the inner and outer circumferential surfaces of the inner and outer caps and engaged to be movable unidirectionally, and first and second protrusions spaced apart from the ratcheting teeth and protruding from the facing portions of the inner and outer caps, for integrally rotating the inner and outer caps from the mouth of the bottle such that the first and second ratcheting protrusions are engaged with each other when the second ratcheting teeth move relative to the first ratcheting teeth by stages, and opening/closing identification means having a portion of displaying whether the cap body has been opened or not, printed on the top surface of the inner cap, and an identification means formed on the top surface of the outer cap, for identifying from the outside whether the cap body has been opened or not, according to movement of the second ratcheting teeth relative to the first ratcheting teeth.

6 Claims, 7 Drawing Sheets

U.S. PATENT DOCUMENTS 4,872,570 A * 10/1989 Harding ..... 215/230
5,092,477 A * 3/1992 Johnson, Jr. et al. ..... 215/230
5,285,912 A 2/1994 Molinaro
5,299,701 A 4/1994 Barker et al.
5,370,251 A * 12/1994 Buono ..... 215/220
6,003,467 A * 12/1999 Shelton-Ferrell et al. ... 116/309

* cited by examiner

BOTTLE CAP

TECHNICAL FIELD

The present invention relates to a bottle cap, and more particularly, to a bottle cap configured such that consumers can easily identify the opening or closing of a cap openably installed on the mouth of a liquor bottle, thereby enhancing the reliability and product value of liquors.

BACKGROUND ART

In general, existing caps for use in liquor bottles are openably configured just by opening or closing the mouth of a liquor bottle. Also, in order to verify that the liquor bottle has never been unsealed, coating paper, e.g., vinyl, or a label has been applied to the outer surface of the liquor bottle cap.

However, a problem associated with the conventional liquor bottle caps is that liquors contained in unsealed bottles may be deceivingly sold to consumers. In other words, even if the liquor contained in a liquor bottle capped with a bottle cap that has been fraudulently opened is deceivingly sold to consumers, the consumers cannot perceive that the liquor has been tampered with, which deteriorates the reliability and product value of the liquor.

As described above, since consumers cannot easily identify the opening or closing of a liquor bottle cap, they may often deceivingly drink fraudulently bottled liquors at a bar or pub.

DISCLOSURE OF THE INVENTION

To solve the above problems, it is an object of the present invention to provide a bottle cap having a portion of displaying whether it has been opened or not, printed on the interior part of the bottle cap, the displaying portion being visible when the bottle cap is opened for the first time, thereby easily identifying whether the bottle cap has been opened or not.

To accomplish the above object of the present invention, there is provided a bottle cap for a bottle which holds contents, including a cap body having an inner cap coupled so as to open or close the mouth of the bottle, and an outer cap made to rotate in a circumferential direction only and fixedly coupled to the inner cap so as not to deviate from the inner cap, ratcheting means having first and second teeth formed at facing portions of the inner and outer circumferential surfaces of the inner and outer caps and engaged to be movable unidirectionally, and first and second protrusions spaced apart from the ratcheting teeth and protruding from the facing portions of the inner and outer caps, for integrally rotating the inner and outer caps from the mouth of the bottle such that the first and second ratcheting protrusions are engaged with each other when the second ratcheting teeth move relative to the first ratcheting teeth by stages, and opening/closing identification means having a portion of displaying whether the cap body has been opened or not, printed on the top surface of the inner cap, and an identification means formed on the top surface of the outer cap, for identifying from the outside whether the cap body has been opened or not, according to movement of the second ratcheting teeth relative to the first ratcheting teeth.

The inner and outer caps may be integrally connected by fixed protrusions and grooves formed at facing portions of inner and outer circumferential surfaces thereof.

The identification means may include convex portions for covering a display portion and concave portions for uncovering a display portion, the convex and concave portions formed along the periphery of an opening hole opened by perforating a portion of the top surface of the outer cap, at the same pitch with the ratcheting teeth.

The identification means may be configured such that holes are formed on a portion of the top surface of the outer cap at the same pitch with the ratcheting teeth to uncover the display portion therethrough.

BRIEF DESCRIPTION OF THE DRAWINGS

The above object and advantages of the present invention will become more apparent by describing in detail a preferred embodiment thereof with reference to the attached drawings in which.

DESCRIPTION OF THE INVENTION

The present invention will now be described in detail with reference to the accompanying drawings.

Figure 1:
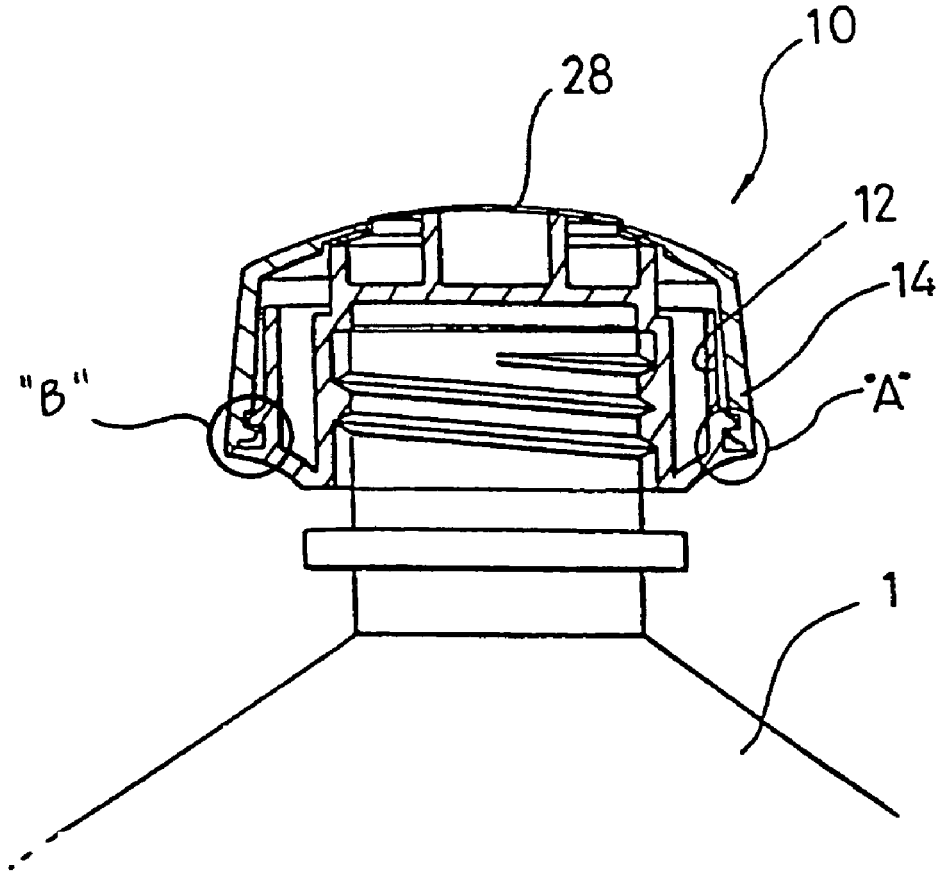
FIG. 1 is a cross-sectional view illustrating the state in which a bottle cap according to the present invention is mounted.
Figure 2A:
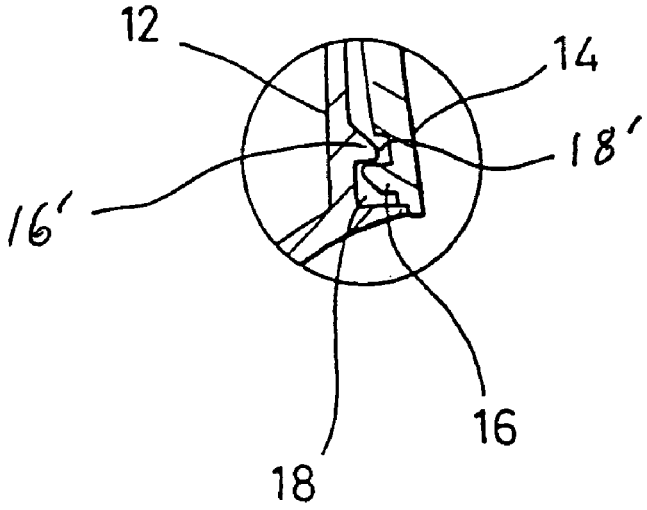
FIG. 2A is an enlarged view of portion "A" of FIG. 1.
Figure 2B:
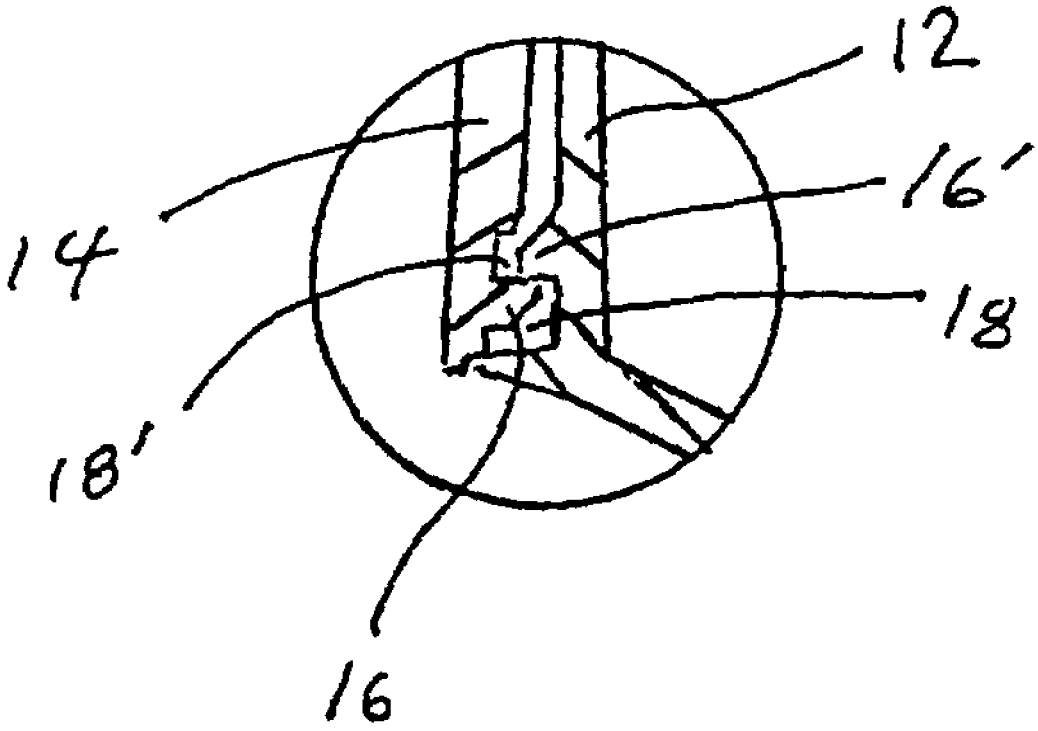
FIG. 2B is an enlarged view of portion "B" of FIG. 1.

FIG. 1 is a cross-sectional view illustrating the state in which a bottle cap according to the present invention is mounted, FIG. 2A is an enlarged view of portion "A" of FIG. 1, and FIG. 2B is an enlarged view of portion "B" of FIG. 1.

As shown in FIG. 1, a bottle cap 10 according to the present invention includes a cap body. The cap body includes an inner cap 12 coupled so as to open or close the mouth of a bottle 1, and an outer cap 14 fixedly coupled to the inner cap 12 so as to rotate in a circumferential direction only.

The inner cap 12 and the outer cap 14 are integrally connected by means of fixed protrusions 16 and grooves 18, as shown in FIG. 2A and FIG. 2B and by means of fixed protrusions 16' and grooves 18', also shown in FIG. 2A and FIG. 2B, so that they are not separated once connected.

As shown, the bottle cap 10 according to the present invention includes an opening/closing identification means of a cap body. The identification means is configured such that an opening/closing display portion 28 on which characters are printed is fixedly connected to the top surface of the inner cap 12 and an opening hole 30 is formed on the top surface of the outer cap 14 so as to identify whether the bottle cap 10 is opened or closed by covering or uncovering the display portion 28. The opening hole 30 will later be described in more detail with reference to FIGS. 8 and 9.

Figure 3:
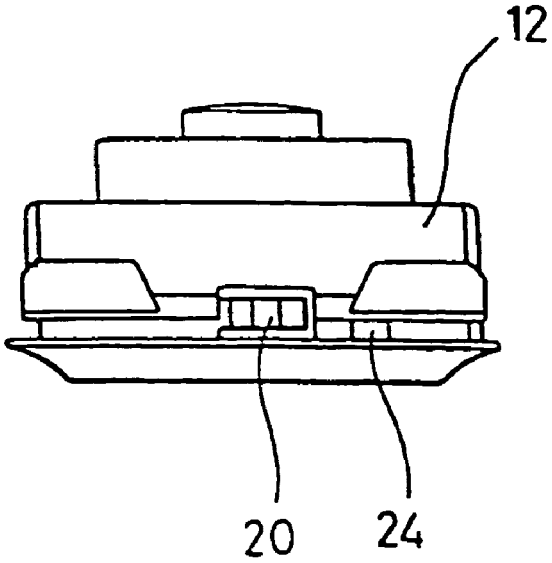
FIG. 3 is a front view of an inner cap of the bottle cap according to the present invention.

FIG. 3 is a front view of an inner cap of a bottle cap according to the present invention.

As shown in FIG. 3, first ratcheting teeth 20 are provided in the inner cap 12. The first ratcheting teeth 20, provided for preventing reverse rotation, are shaped of ratchets, and will now be described in detail with reference to FIGS. 4 through 7.

Figure 4:
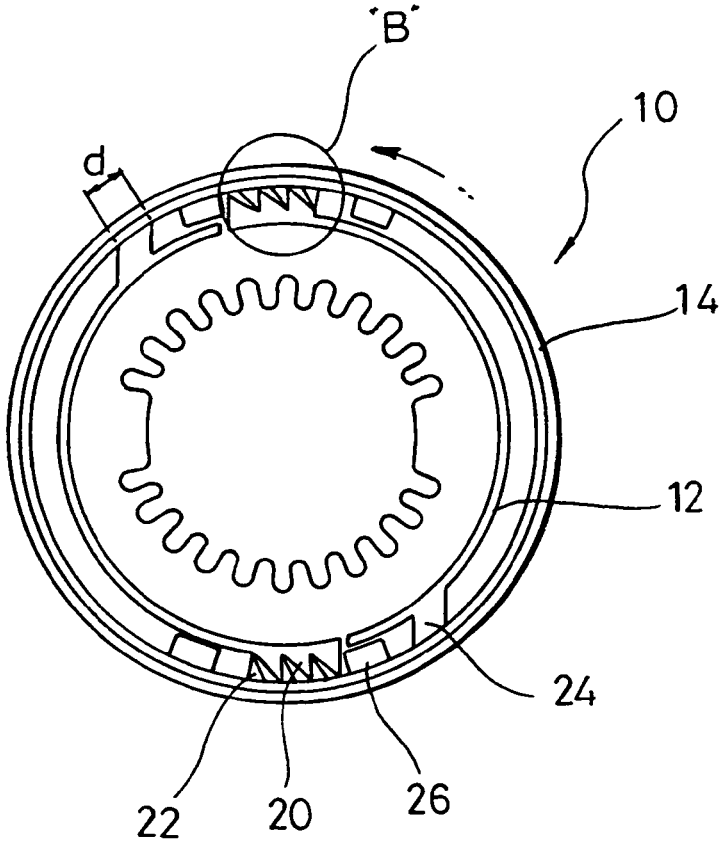
FIG. 4 illustrates the state of the bottle cap according to the present invention before it is opened from the mouth of a bottle.
Figure 5:
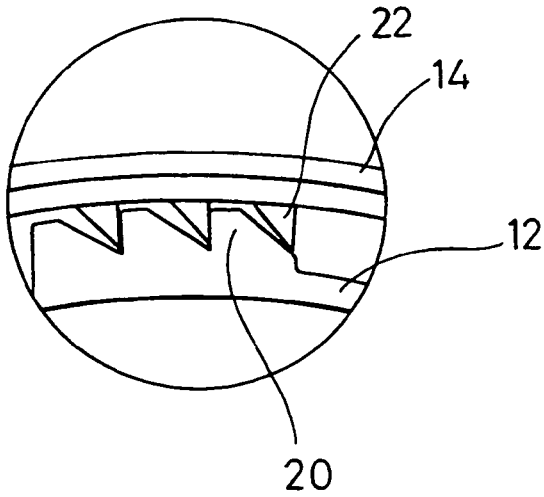
FIG. 5 is an enlarged view of a portion "B" of FIG. 4.
Figure 6:
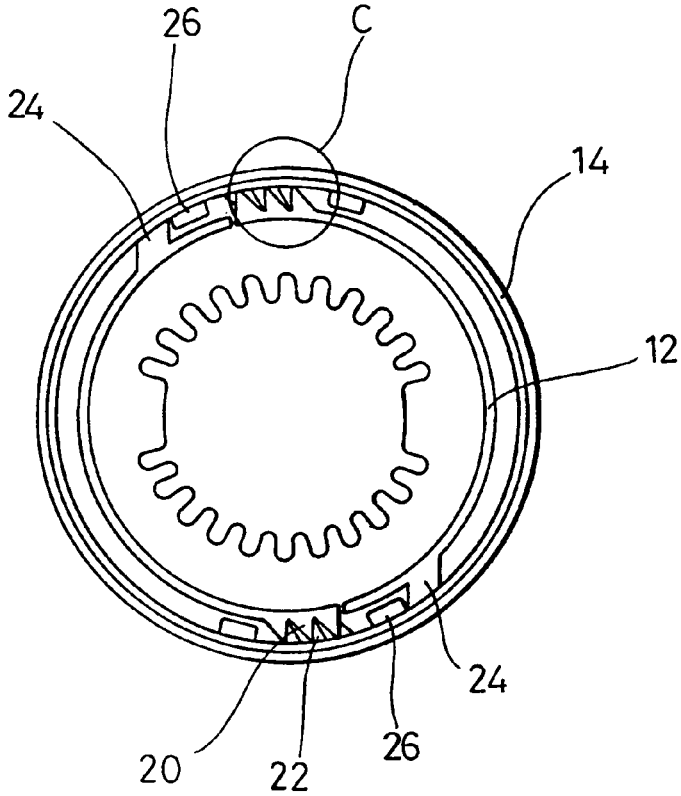
FIG. 6 illustrates the state of the bottle cap according to the present invention after it is opened from the mouth of a bottle.
Figure 7:
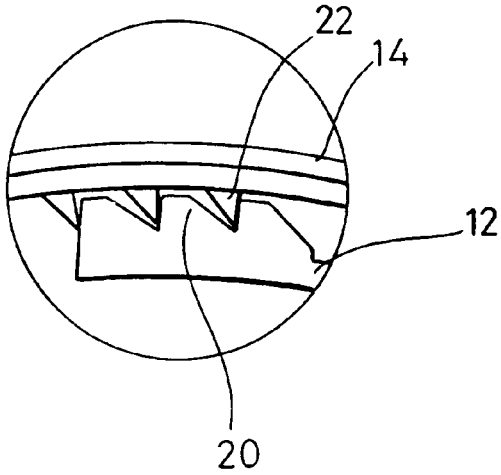
FIG. 7 is an enlarged view of a portion "C" of FIG. 6.

FIG. 4 illustrates the state of the bottle cap according to the present invention before it is opened from the mouth of a bottle, FIG. 5 is an enlarged view of a portion "B" of FIG. 4, FIG. 6 illustrates the state of the bottle cap according to the present invention after it is opened from the mouth of a bottle, and FIG. 7 is an enlarged view of a portion "C" of FIG. 6.

As shown in FIGS. 4 through 7, the bottle cap 10 according to the present invention includes ratcheting means. The ratcheting means includes first and second teeth 20 and 22 formed at facing portions of the outer circumferential surface of the inner cap 12 and the inner circumferential surface of the outer cap 14 and engaged so as to be movable unidirectionally. The first and second teeth 20 and 22 are formed so as to slope unidirectionally, thereby preventing reverse rotation.

If the first teeth 20 are formed on the outer circumferential surface of the inner cap 12, the second teeth 22 are then formed on the inner circumferential surface of the outer cap 14. In such a manner, the first and second teeth 20 and 22 are engaged with each other. The teeth formed on the outer circumferential surface of the inner cap 12 are formed so as to have a tension.

Also, first and second ratcheting protrusions 24 and 26 are spaced apart from the ratcheting teeth and protrude from the facing portions of the inner and outer caps 12 and 14. If the first ratcheting protrusions 24 are formed on the outer circumferential surface of the inner cap 12, the second ratcheting protrusions 26 are then formed on the inner circumferential surface of the outer cap 14.

As shown, two ratcheting means are symmetrically installed at positions where the cap body is divided into two parts. However, four ratcheting means may be symmetrically installed at positions where the cap body is divided into four parts.

As shown in FIGS. 4 and 5, before the bottle cap 10 is opened, the first and second ratcheting teeth 20 and 22 are engaged with each other, and the first and second ratcheting protrusions 24 and 26 are spaced a predetermined distance (d) apart from each other.

In such a state, if the outer cap 14 is rotated for the purpose of opening the bottle cap 10, the first and second ratcheting teeth 20 and 22 move by stages so that only the outer cap 14 rotates at a predetermined angle during an initial stage. In other words, while the ratcheting teeth 22 (or 20) formed on the inner cap 12 are subjected to a tension by the ratcheting teeth 20 (or 22) formed on the outer cap 14, they are pressed inwardly and then restored into their original positions, thereby moving by stages.

The rotation angle of the outer cap 14 is preferably 20", more preferably 10.

The rotation angle of the outer cap 14 is determined by the lengths of the ratcheting teeth.

As described above, if only the outer cap 14 is rotated by a predetermined angle, as shown in FIGS. 6 and 7, the first and second ratcheting protrusions 24 and 26 are engaged with each other, so that the inner cap 12 is rotated accordingly. On and after this time, the inner and outer caps 12 and 14 are rotated together all the time.

If the bottle cap 10 is opened in such a manner, the opening or closing thereof can be easily identified by the identification means, which will be described with reference to FIGS. 8 and 9.

Figure 8:
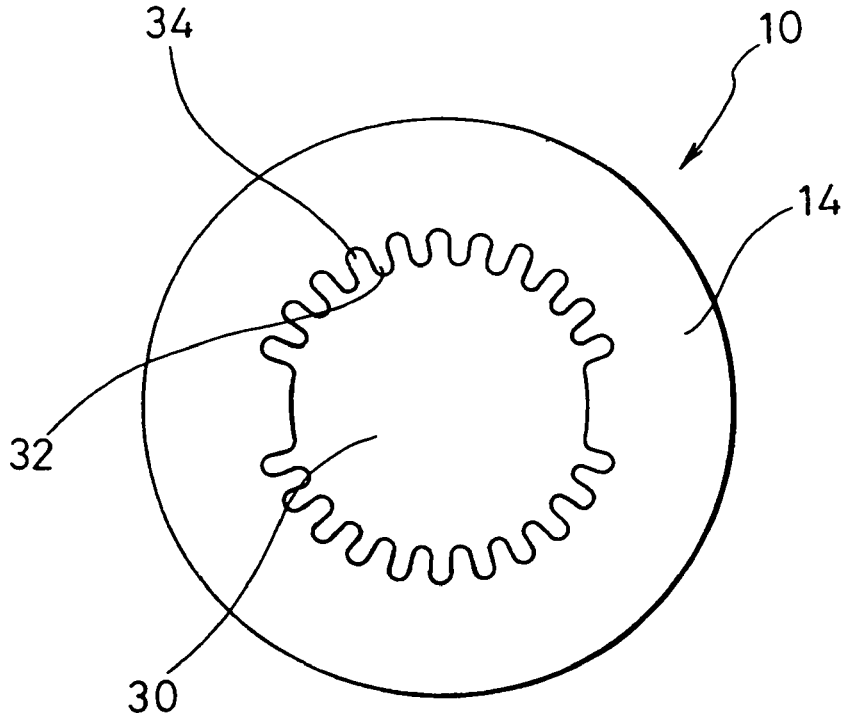
FIG. 8 is a plan view of the bottle cap according to the present invention before it is opened from the mouth of a bottle.
Figure 9:
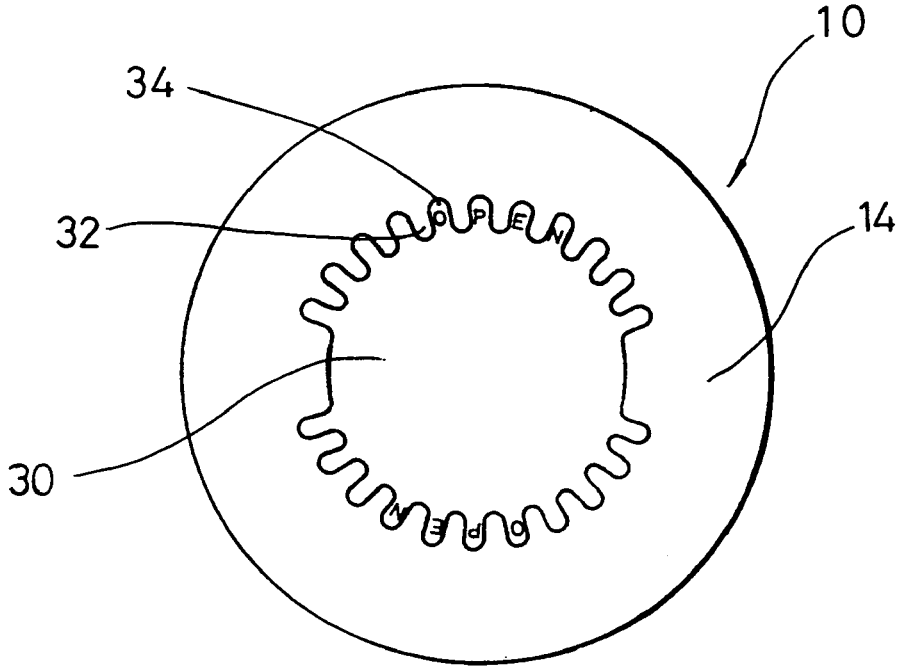
FIG. 9 is a plan view of the bottle cap according to the present invention after it is opened from the mouth of a bottle.

FIG. 8 is a plan view of the bottle cap according to the present invention before it is opened from the mouth of a bottle, and FIG. 9 is a plan view of the bottle cap according to the present invention after it is opened from the mouth of a bottle.

As shown in FIGS. 8 and 9, the bottle cap 10 according to the present invention includes an opening/closing identification means. The identification means includes an opening hole 30 opened by perforating a portion of the top surface of the outer cap 14, convex portions 32 for covering a display portion and concave portions 34 for uncovering a display portion, the convex and concave portions 32 and 34 formed along the periphery of the opening hole 30 at the same pitch with the ratcheting teeth. The convex portions 32 and the concave portions 34 may be either opaque or transparent.

FIG. 8 illustrates the state in which characters printed on the display portion 28 (see FIG. 1) fixedly coupled to the top surface of the inner cap 12 is covered by the convex portions 32 formed along the periphery of the opening hole 30, representing that the bottle cap 10 is not opened.

FIG. 9 illustrates the state in which characters printed on the display portion 28 (see FIG. 1) fixedly coupled to the top surface of the inner cap 12 is visible through the concave portions 34 formed along the periphery of the opening hole 30, representing that the bottle cap 10 is opened. In FIG. 8, the characters visible through the concave portions 34 are OPEN, but are not limited thereto.

Figure 10:
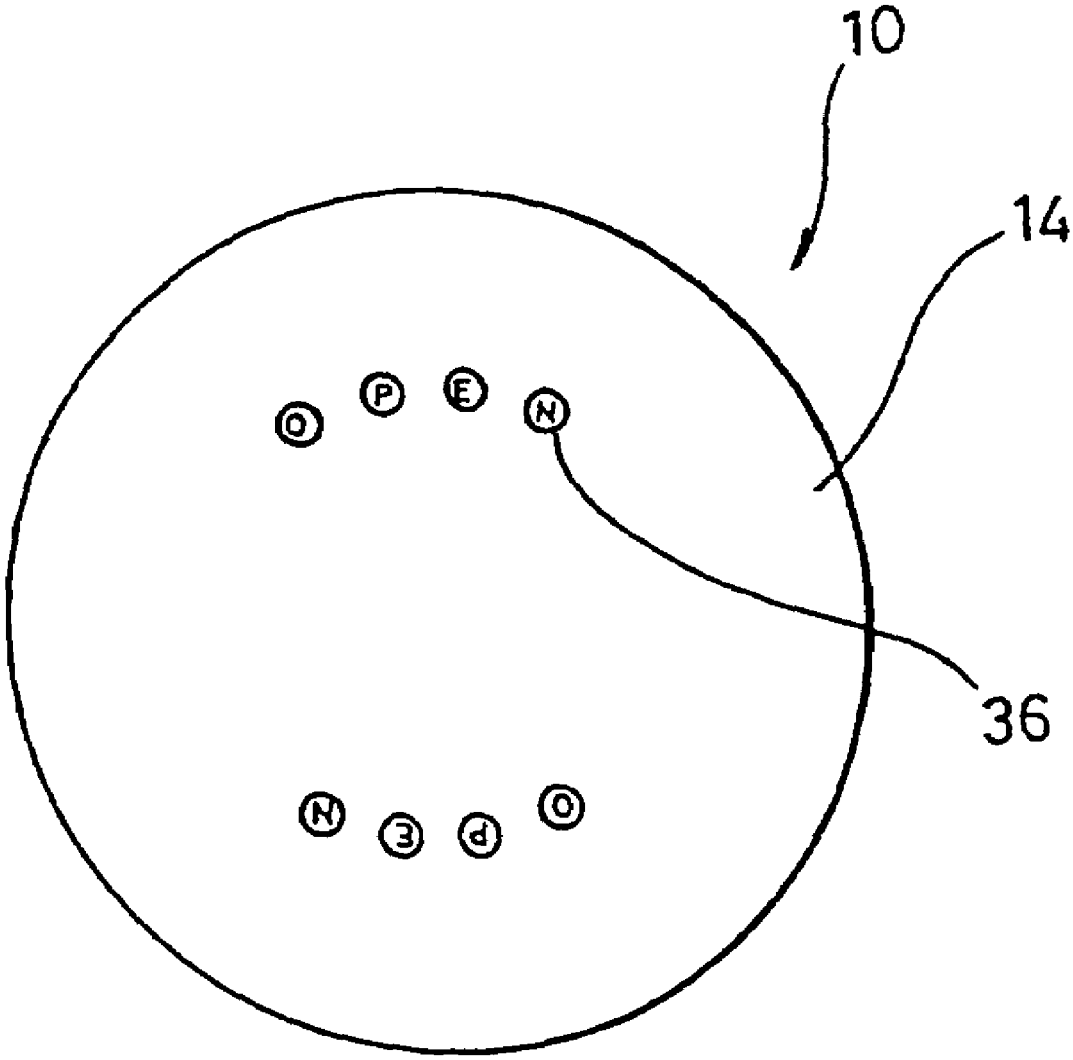
FIG. 10 is a plan view illustrating another embodiment of an identification means for identifying whether the bottle cap according to the present invention has been opened or not.

FIG. 10 is a plan view illustrating another embodiment of the opening/closing identification means of the bottle cap according to the present invention.

As shown in FIG. 10, the opening/closing identification means of the cap body includes holes 36 formed on a portion of the top surface of the outer cap 14 at the same pitch with the ratcheting teeth, thereby identifying whether the bottle cap 10 is opened or closed such that the display portion 28 is visible through the holes 36 when the outer cap 14 is rotated by a predetermined angle. All the components other than the identification means are the same as those of the above-described embodiment.

Also, it is possible to prevent foreign matter such as dust from being induced by installing transparent glass on the holes 36. Further, characters printed on the display portion 28 can be more clearly identified by installing reading glasses or magnifying glasses using convex lenses.

INDUSTRIAL APPLICABILITY

As described above, according to the bottle cap of the present invention, an outer cap and an inner cap are made to race by a predetermined angle only when the bottle cap is opened for the first time, and characters printed on a display portion are visible so as to easily identify the opening or closing of the bottle cap, thereby enhancing the reliability and product value of contents contained in the bottle. The bottle caps according to the present invention can be most effectively applied to liquor bottles.

What is claimed is:

1. A bottle cap for a bottle which holds contents, the bottle cap being moveable between an open position with respect to the bottle and a closed position, the bottle cap comprising:

a cap body having an inner cap coupled so as to open or close the mouth of the bottle, and an outer cap made to rotate in a circumferential direction only and integrally connected to the inner cap so as not to deviate from the inner cap and remain in coupled axial position therewith, said inner cap and said outer cap each including a top surface and a peripheral side wall, each of said side walls including an inner circumferential surface and an outer circumferential surface;

a ratcheting mechanism which operatively associates said inner cap with said outer cap by providing unidirectional engagement between said inner cap and said outer cap, said ratcheting mechanism having a first set and a second set of ratcheting teeth formed at facing portions of the outer and inner circumferential surfaces of the side walls of the inner and outer caps and engaged to be moved unidirectionally, and first and second ratcheting protrusions spaced apart from the first set and the second set of ratcheting teeth and protruding from the facing portions of the outer and inner caps, for integrally rotating the inner and outer caps from the mouth of the bottle such that the first and second ratcheting protrusions are engaged with each other when the second set of ratcheting teeth move relative to the first set of ratcheting teeth by stages, said first set and the second set of ratcheting teeth producing tension between each other when in engagement and moving relative to one another, whereby one of said first set of ratcheting teeth or said second set of ratcheting teeth are pressed inwardly toward the other of said second set of ratcheting teeth or said first set of ratcheting teeth, said first and second protrusions being spaced apart from one another by a predetermined distance when the bottle cap is in its closed position with respect to said bottle; and an opening/closing identification mechanism for displaying whether the cap body has been opened or not, said opening/closing identification mechanism having a display portion which displays whether the cap body had been opened or not, printed on the top surface of the inner cap, and an identification mechanism for identifying from the outside whether the cap body has been opened or not according to the movement of the second set of ratcheting teeth relative to the first set of ratcheting teeth, said identification mechanism being formed on the top surface of the outer cap;

wherein said integral connection of said inner and outer caps is defined by fixed protrusions and grooves formed at facing portions of inner and outer circumferential surfaces thereof.

2. The bottle cap according to claim 1, wherein the identification mechanism includes an opening hole and further includes convex portions for covering said display portion and concave portions for uncovering said display portion, the convex and concave portions formed along a periphery of said opening hole which is opened by perforating a portion of the top surface of the outer cap, at a same spacing as the one of the sets of ratcheting teeth.

3. The bottle cap according to claim 1, wherein said display portion is formed on said inner cap and a plurality of holes is formed in said outer cap, wherein the identification mechanism is configured such that said holes formed on said outer cap are formed at a same spacing as the one of the sets of ratcheting teeth to uncover said display portion therethrough.

4. A bottle cap for a bottle which holds contents, the bottle cap being moveable between an open position with respect to the bottle and a closed position, the bottle cap comprising:

a cap body having an inner cap coupled so as to open or close the mouth of the bottle, and an outer cap made to rotate in a circumferential direction only and integrally connected to the inner cap, said inner cap and remain in coupled axial position therewith and said outer cap each including a top surface and a peripheral side wall, each of said side walls including an inner circumferential surface and an outer circumferential surface;

a ratcheting mechanism which operatively associates said inner cap with said outer cap by providing unidirectional engagement between said inner cap and said outer cap, said ratcheting mechanism having a first and a second set of ratcheting teeth formed at facing portions of the outer and inner circumferential surfaces of the side walls of the outer and inner caps and engaged to be moved unidirectionally, and first and second ratcheting protrusions spaced apart from the first set and the second set of ratcheting teeth and protruding from the facing portions of the inner and outer caps, said first set and second set of ratcheting teeth being formed to produce a tension between each other when in engagement and moving relative to one another, whereby one of said first set of ratcheting teeth or said second set of ratcheting teeth are pressed inwardly toward the other of said second set of ratcheting teeth or said first set of ratcheting teeth and said second protrusions being spaced apart from one another by a predetermined distance when the bottle cap is in its closed position with respect to said bottle; and an opening/closing identification mechanism for displaying whether the cap body has been opened or not, said opening/closing identification mechanism having a display portion which displays whether the cap body had been opened or not, printed on the top surface of the inner cap, and an identification mechanism for identifying from the outside whether the cap body has been opened or not, said identification mechanism being formed on the top surface of the outer cap;

wherein said integral connection of said inner and outer caps is defined as fixed protrusions and grooves formed at facing portions of inner and outer circumferential surfaces thereof.

5. The bottle cap according to claim 4, wherein the identification mechanism includes an opening hole and further includes convex portions for covering said display portion and concave portions for uncovering said display portion, the convex and concave portions formed along a periphery of said opening hole which is opened by perforating a portion of the top surface of the outer cap.

6. The bottle cap according to claim 4, wherein said display portion is formed on said inner cap and a plurality of holes is formed in said outer cap, wherein the identification mechanism is configured such that said holes are formed on said outer cap.

* * * * *